US007370501B2

(12) United States Patent
Miyata et al.

(10) Patent No.: US 7,370,501 B2
(45) Date of Patent: May 13, 2008

(54) KEY UNIT

(75) Inventors: Kazuhiro Miyata, Miyazaki (JP); Mikihiko Kawase, Miyazaki (JP); Kyoutarou Yoshii, Miyazaki (JP)

(73) Assignee: Kabushiki Kaisha Honda Lock, Miyazaki (JP)

( * ) Notice: Subject to any disclaimer, the term of this patent is extended or adjusted under 35 U.S.C. 154(b) by 0 days.

(21) Appl. No.: 11/712,586

(22) Filed: Mar. 1, 2007

(65) Prior Publication Data

US 2007/0220936 A1 Sep. 27, 2007

(30) Foreign Application Priority Data

Mar. 22, 2006 (JP) ..... 2006-079330
Mar. 22, 2006 (JP) ..... 2006-079331
Mar. 22, 2006 (JP) ..... 2006-079332

(51) Int. Cl.
*E05B 19/00* (2006.01)

(52) U.S. Cl. ..... 70/395; 70/408; 70/459

(58) Field of Classification Search ..... 70/395–397, 70/399, 401, 408, 456 R, 459, 460; 24/3.6; 206/38.1, 37.1, 37.2, 37.3, 37.4, 37.5, 37.6, 206/37.7, 37.8

See application file for complete search history.

(56) References Cited

U.S. PATENT DOCUMENTS 2,790,319 A * 4/1957 Brunner ..... 70/456 R
2,822,684 A * 2/1958 Ray ..... 70/456 R
3,079,784 A * 3/1963 Pavlowski ..... 70/456 R
3,841,120 A * 10/1974 Gartner ..... 70/395
4,888,970 A * 12/1989 Kinzler et al. ..... 70/456 R
5,083,662 A * 1/1992 Bishop et al. ..... 206/37.1
6,705,141 B1 * 3/2004 Jacob et al. ..... 70/408
6,892,558 B2 * 5/2005 Chodosh ..... 70/456 R
2007/0062229 A1 * 3/2007 Miyata et al. ..... 70/408

FOREIGN PATENT DOCUMENTS

JP 63-110377 5/1988

* cited by examiner

*Primary Examiner*—Lloyd A. Gall
(74) *Attorney, Agent, or Firm*—Arent Fox LLP

(57) ABSTRACT

A key unit includes a grip case which includes at least a pair of synthetic resin case members joined to each other, and a mechanical key supported in the grip case and having a pivotable key head. A plurality of fitting projections are projectingly provided integrally on a metal holder ring held between the case members. The fitting projections are respectively fitted into a plurality of fitting holes provided in at least one of the case members. An engagement hook resiliently engaging with an engagement hole provided in the holder ring is projectingly provided integrally on one of the case members. This facilitates assembling and enhances assembly strength in attaching the metal holder ring to the grip case.

3 Claims, 20 Drawing Sheets

KEY UNIT

RELATED APPLICATION DATA

The present invention is based upon Japanese priority application Nos. 2006-79330, 2006-79331 and 2006-79332, which are hereby incorporated in their entirety herein by reference.

BACKGROUND OF THE INVENTION

1. Field of the Invention

The present invention relates to a key unit comprising: a grip case which includes at least a pair of synthetic resin case members joined to each other; and a mechanical key which is supported in the grip case and which includes a key plate capable of being inserted into a cylinder lock and a key head joined to one end of the key plate; the mechanical key being capable of pivoting the mechanical key between a retracted position in which the entire mechanical key is retracted and a projecting position in which the key plate projects.

2. Description of Related Art

Such a key unit is already known from, for example, Japanese Patent Application Laid-open No. 63-110377, in which a key head of a mechanical key is supported in a grip case so that the mechanical key can be shifted between a retracted position in which the entire mechanical key is retracted and a projecting position in which the key plate is made to project.

If a key holder can be connected to the grip case, it is convenient for carrying the key unit. Therefore, there is a demand for a metal holder ring attached to the grip case in order to connect a key holder to the metal holder ring. In the conventional device, an opening for connecting a key holder is generally provided in the grip case. However, the thickness of the grip case has been increasing in recent years due to various additional functions effected by immobilizer communication means built in the key head of the mechanical key, keyless entry communication means built in the grip case and the like, so that a key holder inevitably becomes large in the arrangement where the grip case has an opening for connecting a key holder thereto.

In order to avoid such a situation, it is conceivable that a metal holder ring separate from the grip case is attached to the grip case. In this case, a relatively large load acts on a portion of the holder ring attached to the grip case, and thus an attachment strength capable of withstanding such a load is required for attaching the holder ring to the grip case. Further, it is desirable to facilitate an operation for attaching the holder ring to the grip.

SUMMARY OF THE INVENTION

The present invention has been accomplished under the above-mentioned circumstances, and it is an object thereof to provide a key unit wherein assembling is facilitated and enhances assembly strength is enhanced in attaching the metal holder ring to the grip case.

In order to achieve the above object, according to a first feature of the present invention, there is provided a key unit comprising: a grip case which includes at least a pair of synthetic resin case members joined to each other; and a mechanical key which is supported in the grip case and which includes a key plate capable of being inserted into a cylinder lock and a key head joined to one end of the key plate; the mechanical key being capable of pivoting the mechanical key between a retracted position in which the entire mechanical key is retracted and a projecting position in which the key plate projects, wherein the key unit further comprises a metal holder ring which is held between the two case members and which integrally includes a plurality of fitting projections, the fitting projections respectively being fitted into a plurality of fitting holes provided in at least one of the case members; and wherein an engagement hook is projectingly provided integrally on one of the case members so as to resiliently engage with an engagement hole provided in the holder ring.

With the first feature, the pair of case members are joined to each other in a state in which the engagement hook provided on one of the case members forming at least part of the grip case resiliently engages with the engagement hole of the metal holder ring and the plurality of fitting projections of the holder ring are fitted into the fitting holes of at least one of the case members, whereby the metal holder ring is attached to the grip case while the holder ring is clamped between the case members. Further, resilient engagement of the engagement hook with the engagement hole enables the holder ring to be provisionally assembled to one of the case members, thus facilitating assembling. Furthermore, the plurality of fitting projections of the holder ring are fitted into the fitting holes of at least one of the case members, and an external force acting on the holder ring is dispersed to a plurality of positions and acts on the positions where the holder ring is attached to the grip case, thus enhancing the assembly strength.

According to a second feature of the present invention, in addition to the first feature, the key plate has a circular support hole; the grip case comprises, as some of the components, a support member having a support shaft fitted into the support hole, and a clamping member secured to the support member with the key head held between the clamping member and the support member; a torsion spring has one end engaging with the key head so as to exhibit a resilient force for urging the mechanical key to a side that causes the key plate to project, and has the other end engaging with a spring-latching portion provided on the clamping member; the clamping member is provided integrally with a support tube fitted and connected to an extremity of the support shaft; the support shaft includes, around a periphery, a spring-engagement position and a securing position, in the spring-engagement position the torsion spring in a natural state with one end engaged with the key head without exhibiting no spring force causes the other end to be engaged with the spring-latching portion of the clamping member which is not secured to the support member, and in the securing position the clamping member having the torsion spring engaged with the spring-latching portion is pivoted by a predetermined amount to a side that causes the torsion spring to exhibit a resilient force; a positioning restricting portion is provided on the support member so as to abut against the clamping member that has been pivoted from the spring-engagement position to the securing position around an axis of the support shaft; and the clamping member abutting against the positioning restricting portion is secured to the support member.

With the second feature, the support shaft of the support member is fitted into the support hole of the key head, the torsion spring having one end engaging with the key head in a natural state has the other end engaging with the spring-latching portion of the clamping member disposed at the spring-engagement position in a state in which the support tube is fitted and connected to the extremity of the support shaft, the clamping member is cause to abut against the positioning restricting portion by pivoting it around the support shaft while twisting it from the spring-engagement position to the side on which the torsion spring exhibits a resilient force, whereby the support member reaches the securing position and the torsion spring is twisted so as to exhibit a predetermined resilient force. In this state, the clamping member can be secured to the support member, that is, it is possible to secure the clamping member to the support member by a simple assembly operation without requiring a special tool or a skilled worker, thereby reducing the number of assembling steps.

According to a third feature of the present invention, in addition to the first feature, abutment surfaces are respectively formed on the support member and the clamping member on a plane perpendicular to the axis of the support shaft, the abutment surfaces abutting against each other such that the spring force urging the clamping member away from the support member is received in a direction in which the abutment surfaces are in pressure contact with each other when the clamping member is at the securing position.

With the third feature, pivoting the clamping member so as to abut against the positioning restricting portion causes the abutment faces of the support member and the clamping member to come into pressure contact with each other by the spring force acting on the clamping member. Thus, the pressure contact between the abutment faces generates a frictional force which prevents the clamping member from returning from the securing position to the spring-engagement position even when a hand is detached from the clamping member, thus facilitating the assembly operation.

The above-mentioned features, other features, characteristics, and advantages of the present invention will become apparent from a preferred embodiment which will be described in detail below by reference to the attached drawings.

DESCRIPTION OF THE PREFERRED EMBODIMENT

Figure 1:
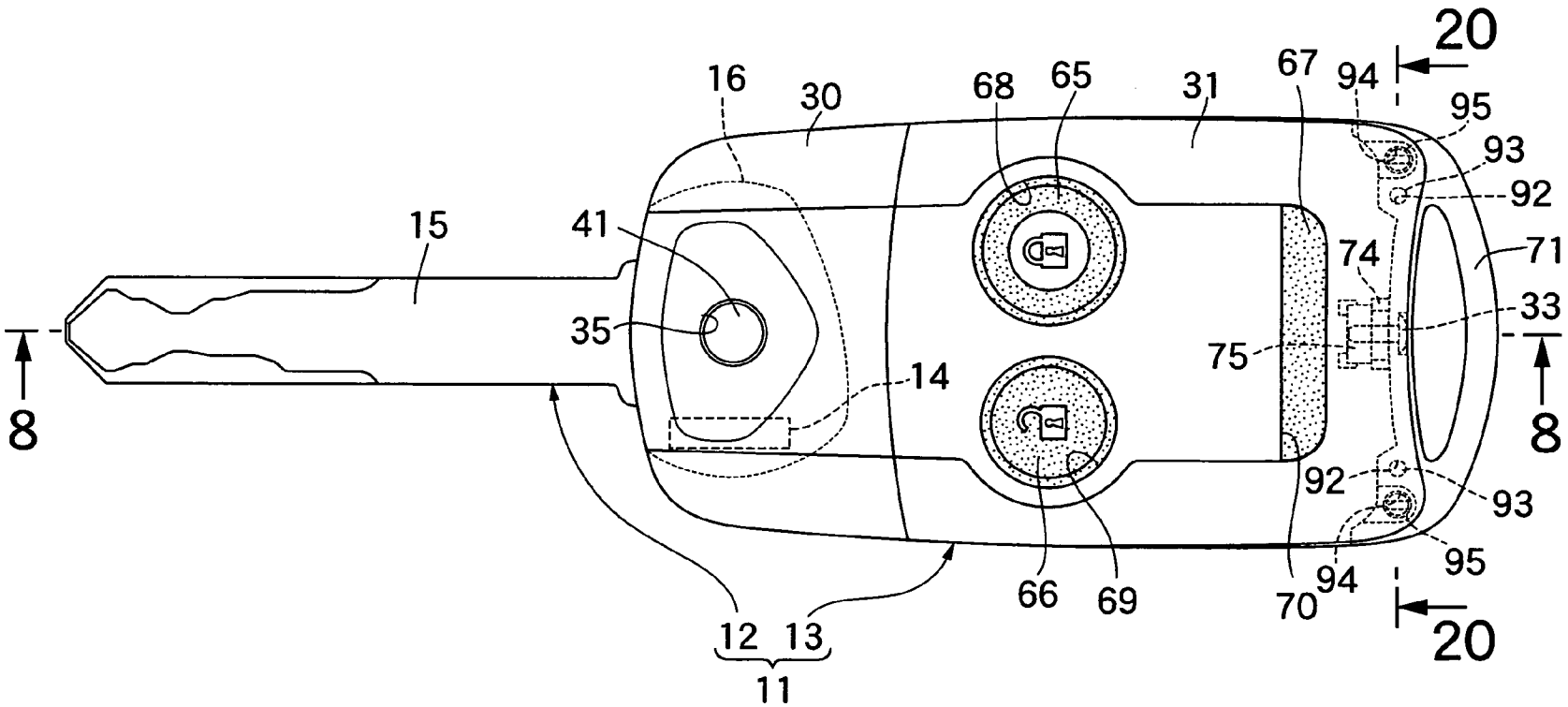
FIG. 1 is a side view of a key unit in a state in which a mechanical key according to a preferred embodiment of the present invention is in a projecting position.
Figure 2:
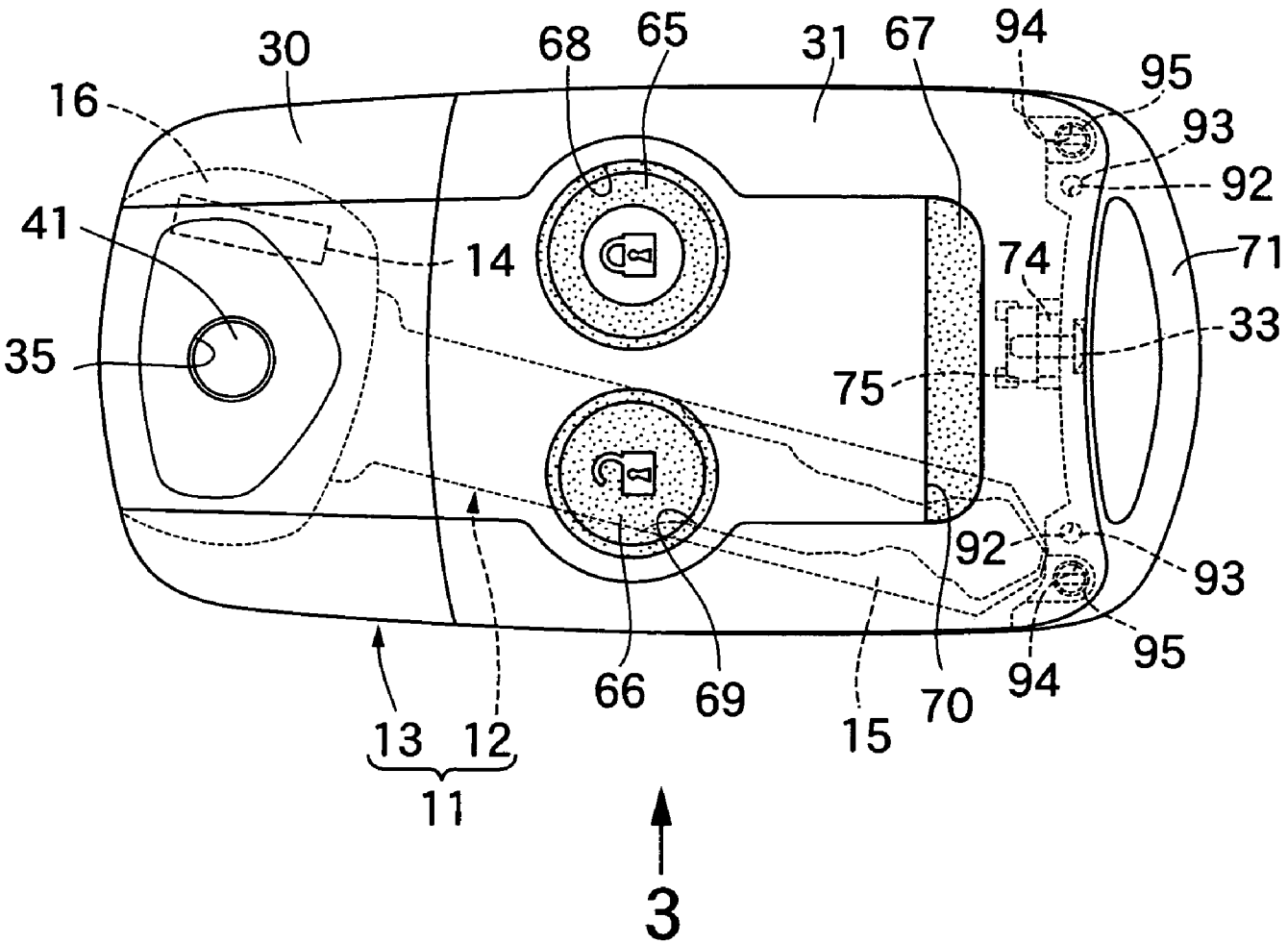
FIG. 2 is a side view of the key unit in a state in which the mechanical key is in a retracted position.
Figure 3:
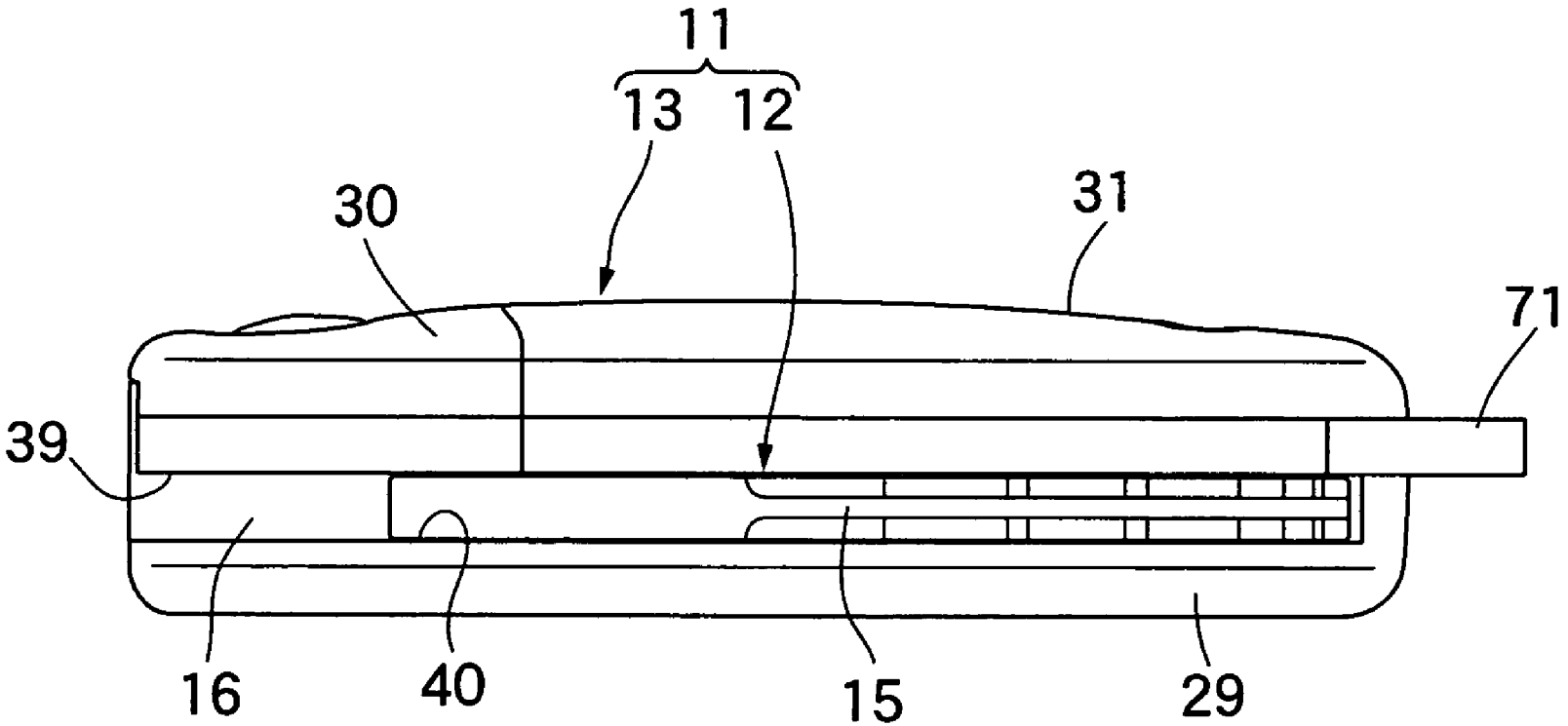
FIG. 3 is a view from arrow 3 in FIG. 2.

Referring first to FIG. 1 to FIG. 3, a key unit 11 comprises a mechanical key 12, and a grip case 13 supporting the mechanical key 12 so that the mechanical key 12 can pivot between a retracted position in which the entire mechanical key 12 is retracted and a projecting position in which part of the mechanical key 12 projects.

Figure 4:
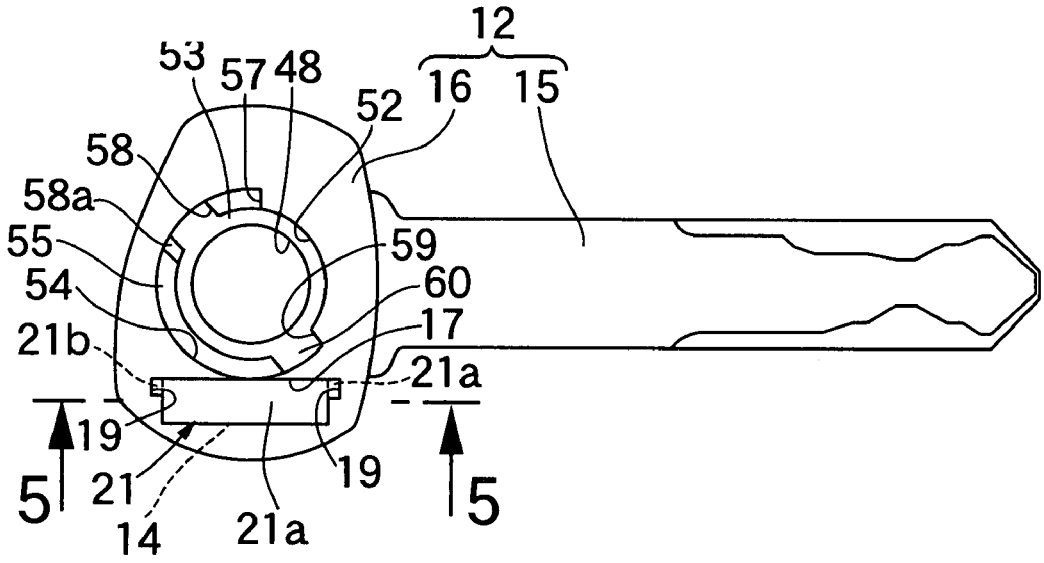
FIG. 4 is a side view when the mechanical key is viewed from a side opposite to that in FIG. 1.
Figure 5:
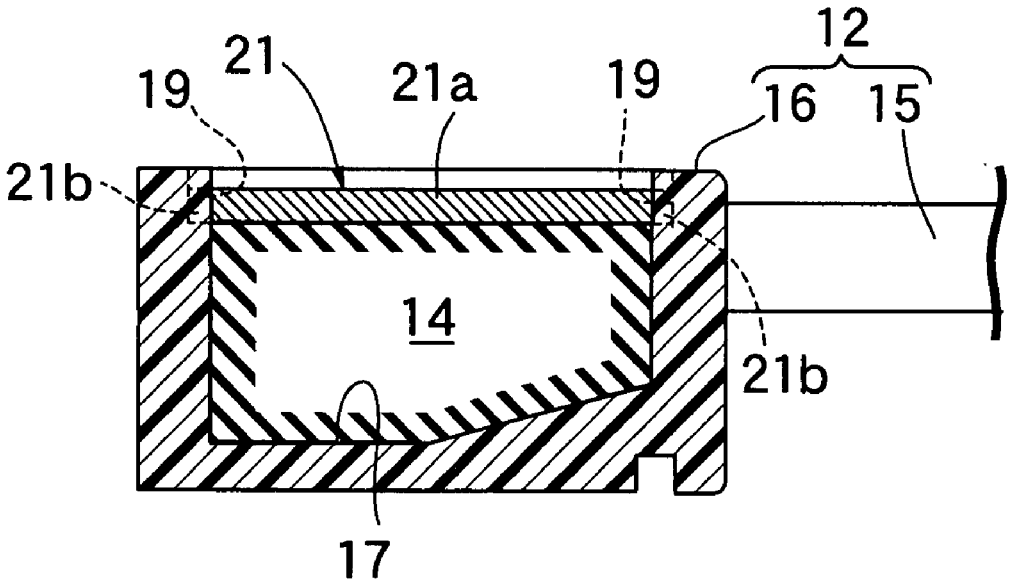
FIG. 5 is a sectional view along line 5-5 in FIG. 4.

In FIG. 4 and FIG. 5, the mechanical key 12 comprises a metal key plate 15 and a key head 16 joined to one end of the key plate 15. The key head 16 is formed from a synthetic resin such that one end of the key plate 15 is insert-bonded thereto. Further, the key head 16 includes a rectangular housing recess 17 extending parallel to the longitudinal direction of the key plate 15 so as to open on one side face of the key head 16. Furthermore, the key head 16 includes recesses 19 and 19 communicating with opposite ends of the housing recess 17 in the longitudinal direction thereof and at one end in the width direction, the recesses 19 and 19 being shallower than the housing recess 17.

The housing recess 17 houses a transponder 14. A lid member 21 is bonded to the key head 16 so as to retain the transponder 14 within the housing recess 17. The lid member 21 integrally has a lid portion 21*a* covering the housing recess 17, and a pair of projections 21*b* and 21*b* connected to the lid portion 21*a* so as to fit into the respective recesses 19.

Figure 6:
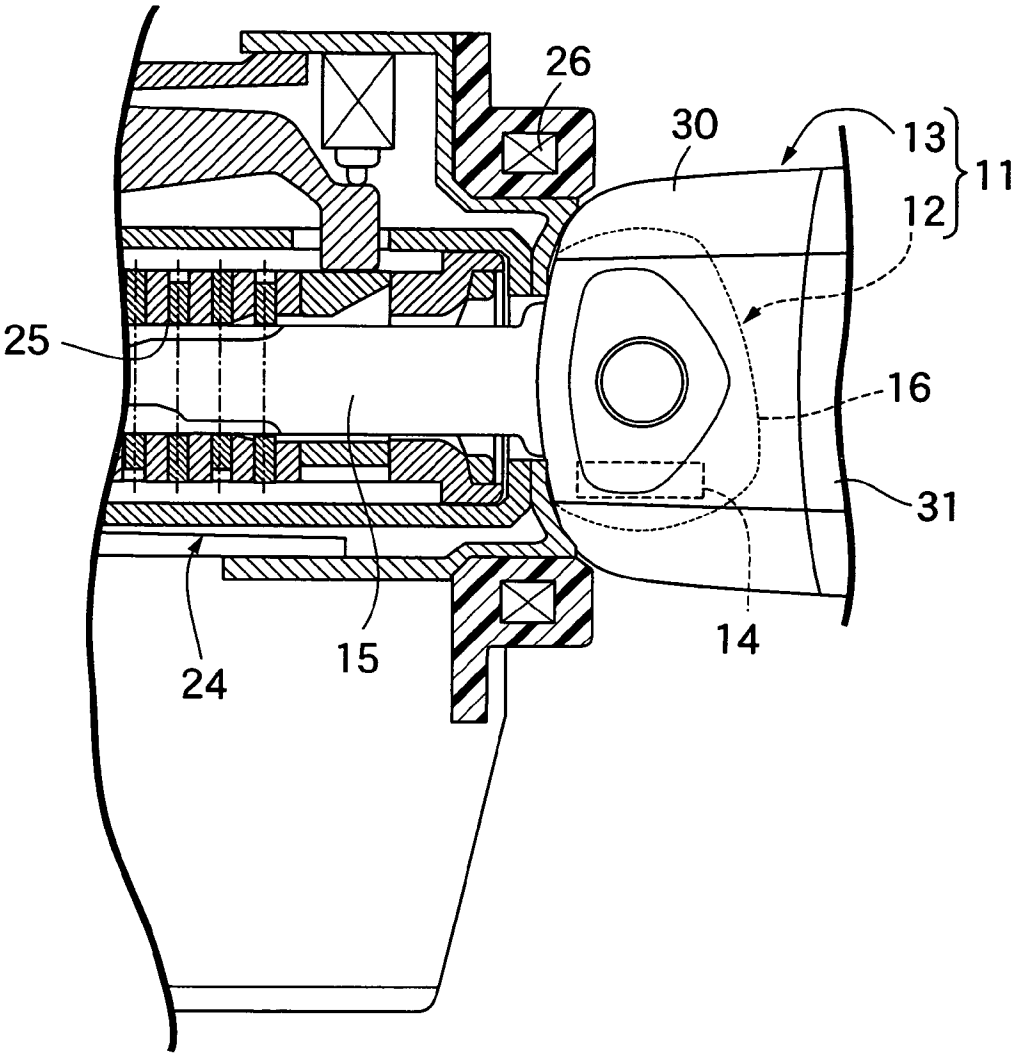
FIG. 6 is a vertical sectional side view showing a state in which the mechanical key is inserted into a cylinder lock.

The key head 16 of the mechanical key 12 is supported in the grip case 13 so that it can pivot between a retracted position (position shown in FIG. 2 and FIG. 3) in which the entire mechanical key 12 is retracted and a projecting position (position shown in FIG. 1) in which the key plate 15 of the mechanical key 12 projects. The key plate 15 projecting from the grip case 13 is inserted into a key hole 25 of a cylinder lock 24 as shown in FIG. 6, the cylinder lock 24 locking and unlocking a steering wheel of a vehicle and switching an engine on and off. When the key plate 15 is inserted into the key hole 25, the transponder 14 receives an electromagnetic force from a coil 26 provided at the front end of the cylinder lock 24, and transmits a specific ID signal, and when it is confirmed that the ID code coincides with a preset ID code on the cylinder lock 24 side, the key unit 11 is allowed to start the engine.

Figure 7:
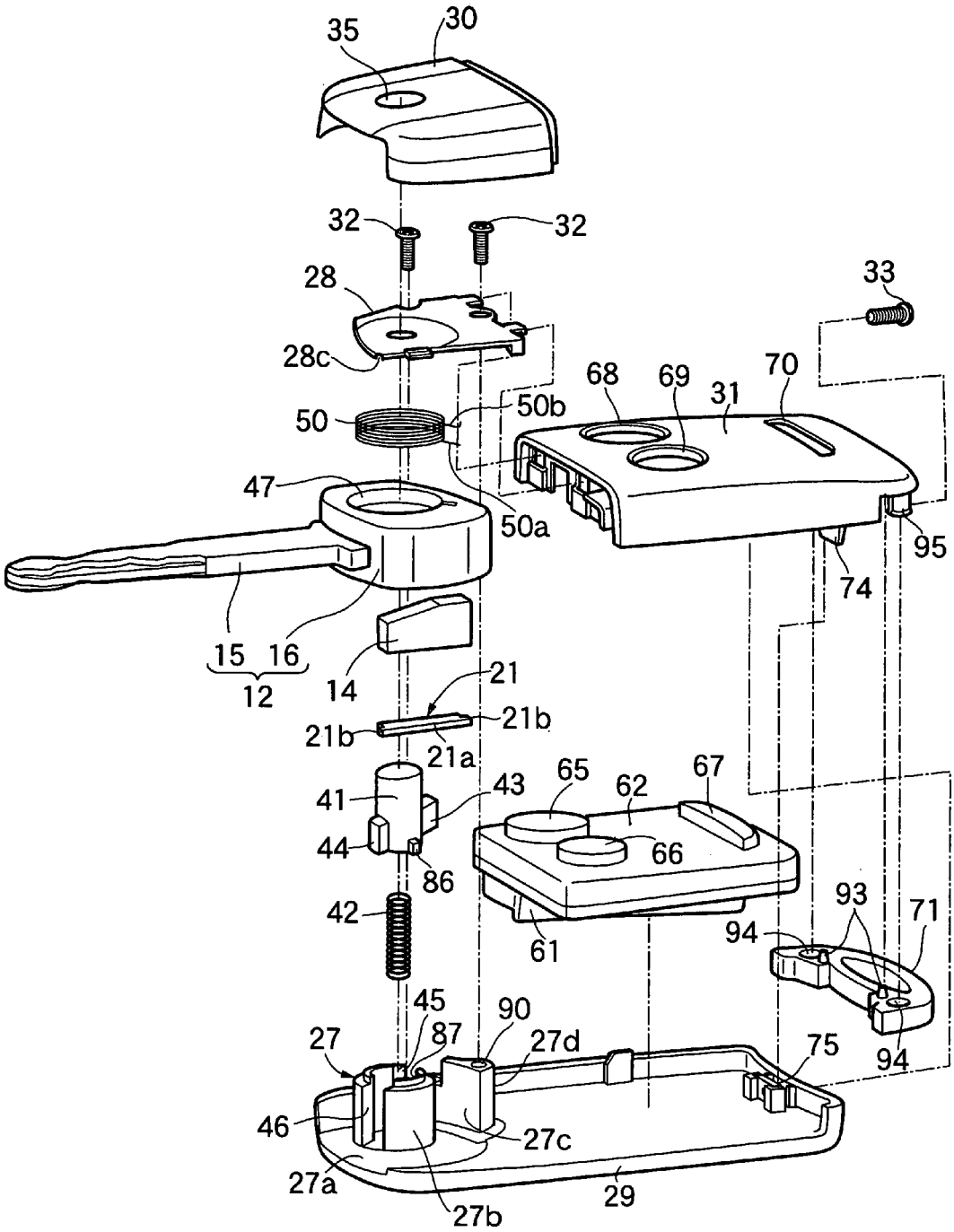
FIG. 7 is an exploded perspective view of the key unit.
Figure 8:
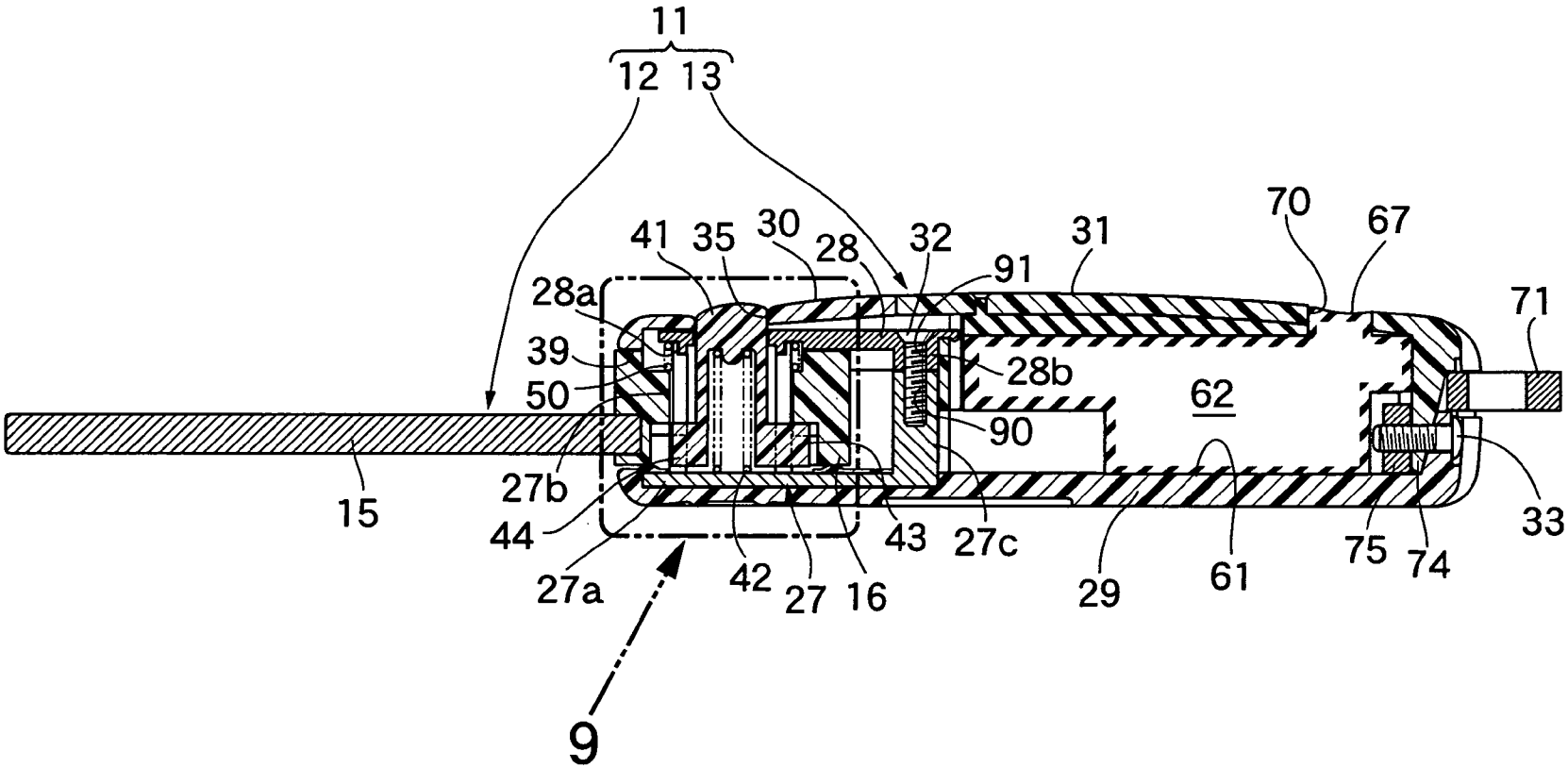
FIG. 8 is a sectional view along line 8-8 in FIG. 1.
Figure 9:
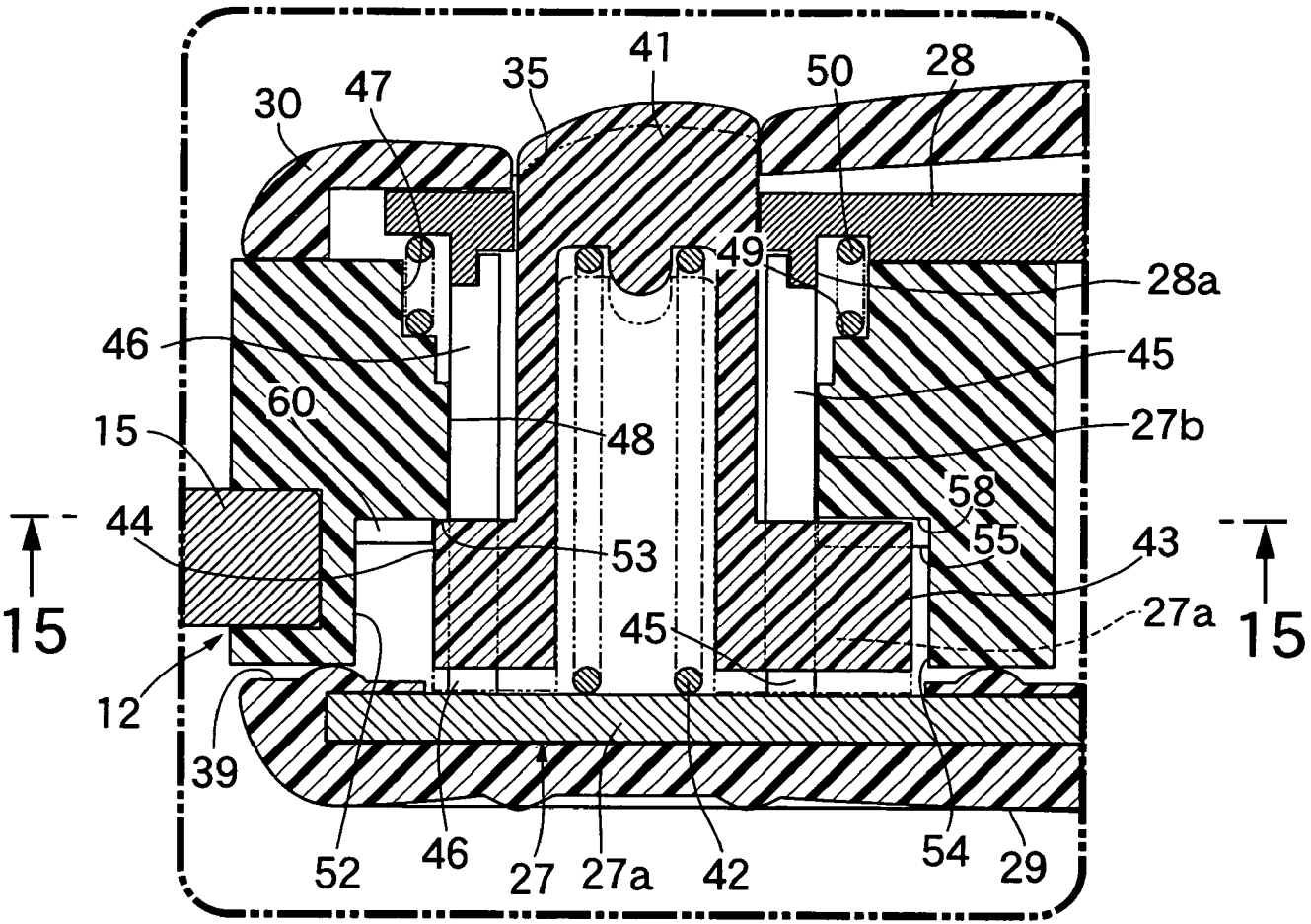
FIG. 9 is an enlarged view of a part shown by arrow 9 in FIG. 8.

Referring also to FIG. 7 to FIG. 9, the grip case 13 includes: a lower case 27 formed from a metal, for example, a light metal such as a zinc alloy; an upper case 28 formed from a metal, for example, a light metal such as a zinc alloy, and joined to the lower case 27 by means of screw members 32 and 32; a module case 29 formed from a synthetic resin, and having a part of the lower case 27 insert-bonded to one end part; a synthetic resin cover 30 ultrasonically welded to the module case 29 so as to cover the upper case 28; and a synthetic resin module cover 31 resiliently engaged with the cover 30 and the module case 29, and secured to the module case 29 by means of a screw member 33.

Figure 10:
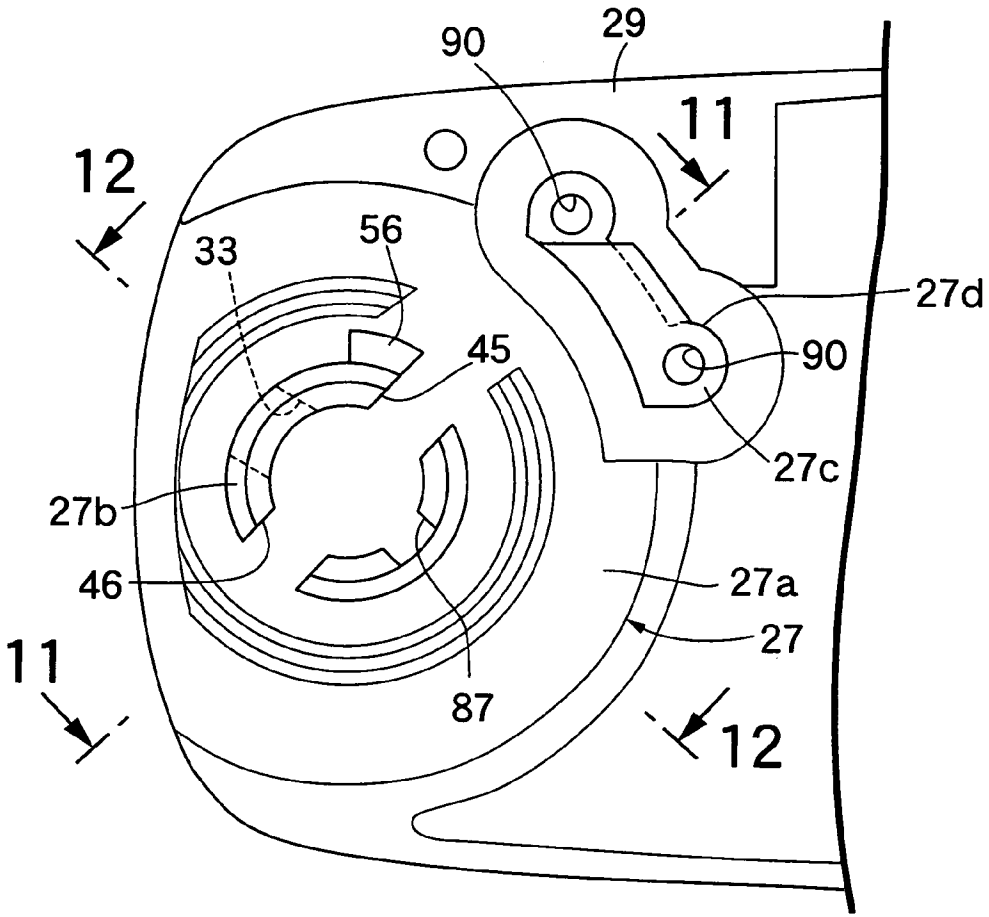
FIG. 10 is a side view showing one part of a module case in a state in which a lower case is insert-bonded thereto.

Referring also to FIG. 10, the lower case 27 integrally includes: a flat base plate 27*a*; a cylindrical support shaft 27*b* connected to the base plate 27*a* at right angles so as to project toward the upper case 28; and a connecting wall portion 27*c* having an arc-shaped cross-section and surrounding a part of the support shaft 27*b*, the base plate 27*a* being insert-bonded to an inner face of the module case 29.

Figure 11:
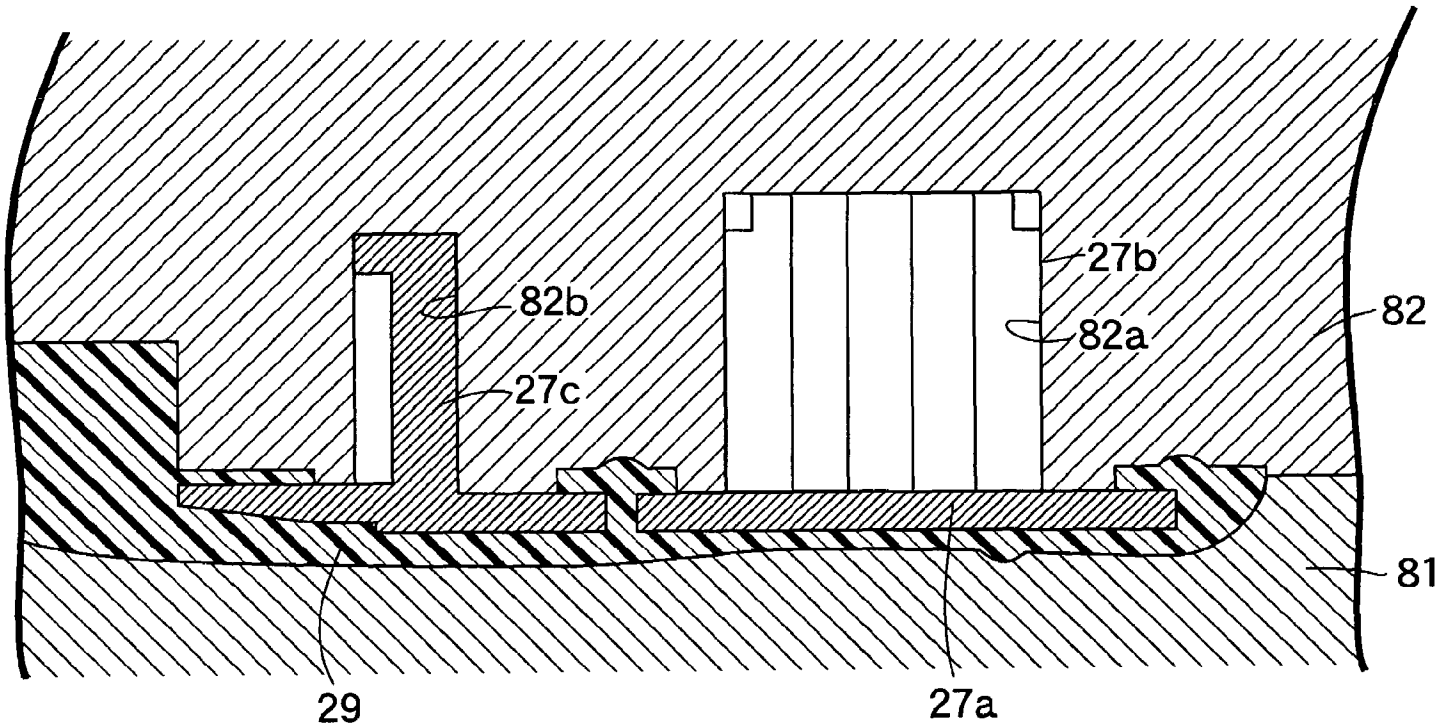
FIG. 11 is a sectional view along line 11-11 in FIG. 10, showing a state when the module case is being molded.
Figure 12:
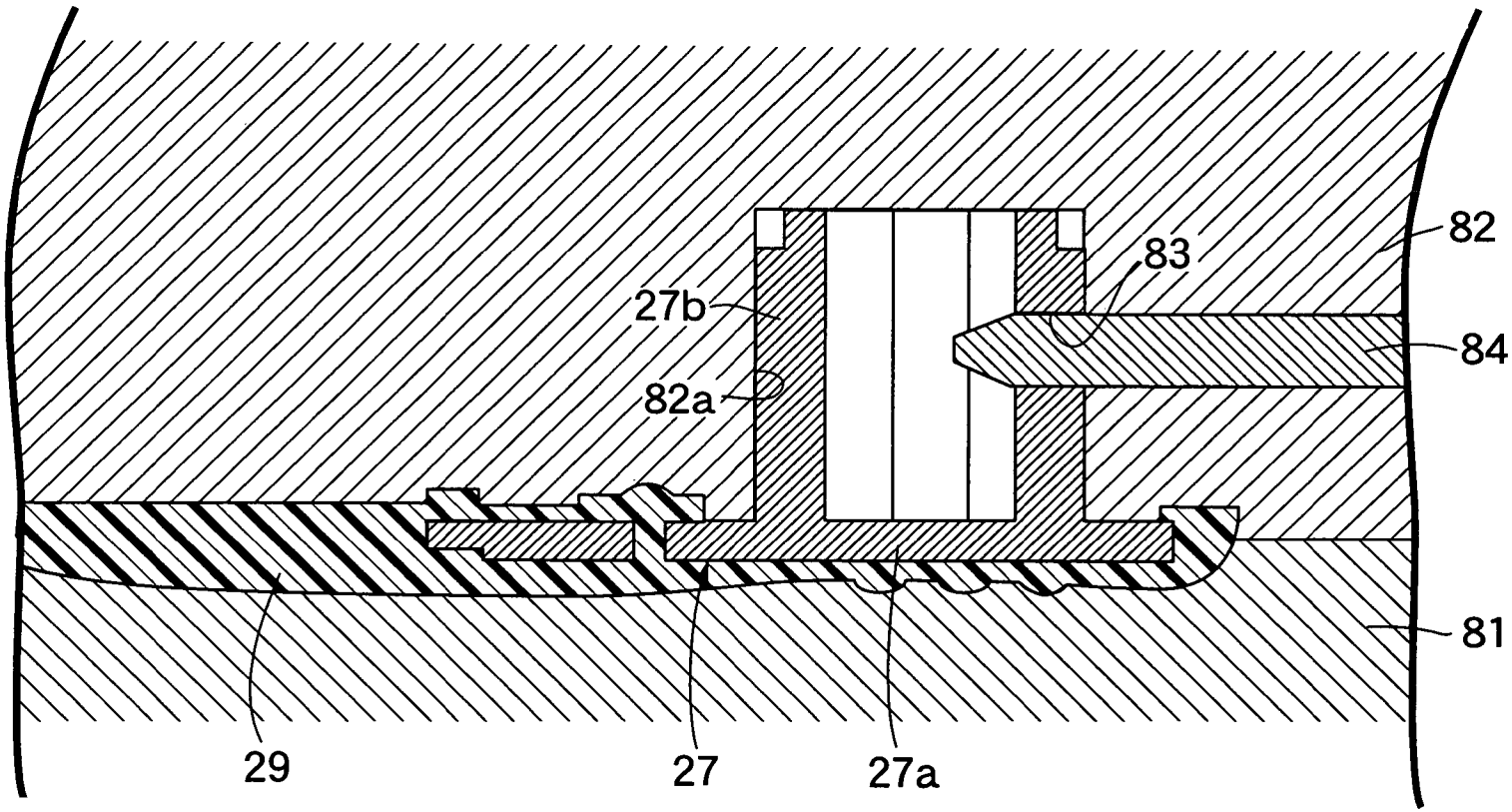
FIG. 12 is a sectional view along line 12-12 in FIG. 10 showing a state when the module case is being molded.

As shown in FIG. 11 and FIG. 12, used in molding the module case 29 are a first mold 81 for molding the outer face of the module case 29, and a second mold 82 for molding the inner face of the module case 29 and being capable of moving toward and away from the first mold 81 so as to abut against the base plate 27*a* of the lower case 27. In order to determine the position of the lower case 27 in a direction perpendicular to the axis of the support shaft 27*b*, fitting recesses 82*a* and 82*b* are provided in the second mold 82 so as to receive the support shaft 27*b* and the connecting wall portion 27*c*.

In recent years, the key unit 11 has become a status symbol for an automobile, and thus its design is important. However, since various types of components are housed within the grip case 13, it is necessary to thin the synthetic resin module case 29 which forms a part of an outer shell of the grip case 13 in order to suppress the thickness of the entire grip case 13. In this connection, if there is a variation in the position of the lower case 27 which is partially insert-bonded to the module case 29, a weld or a sink mark is formed on the design surface of the module case 29, thus degrading the merchantability. In order to form the outer face of the module case 29 to be a stable and reliable design surface so as to reliably determine the position of the lower case 27 partially insert-molded to the module case 29 in the thicknesswise direction of the module case 29, a slide mold 84 is provided in the second mold 82 so that it can move in the radial direction of the support shaft 27*b* so as to engage with an engagement hole 83 provided in the support shaft 27*b* and determine the position of the lower case 27 along the axial direction of the support shaft 27*b*.

Figure 13:
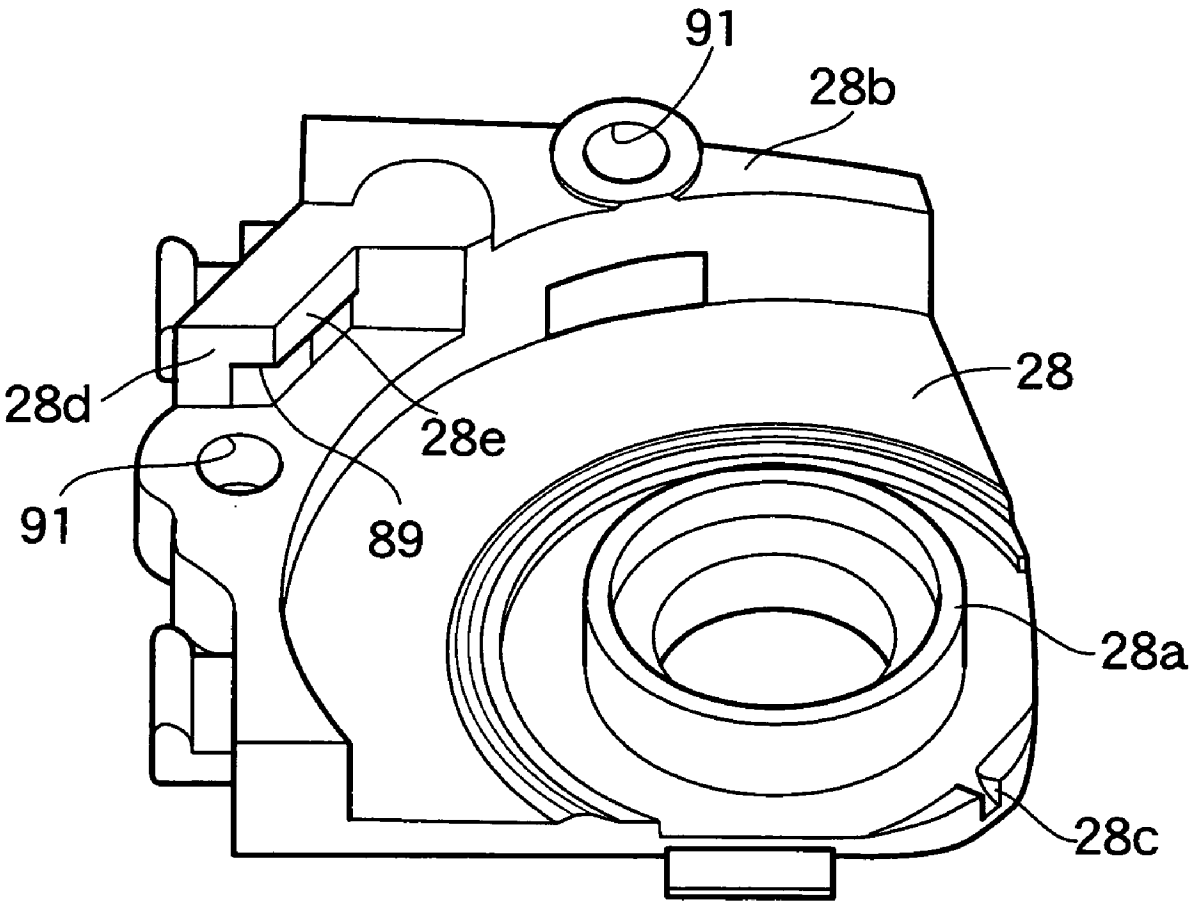
FIG. 13 is a perspective view of an upper case.

Referring also to FIG. 13, the upper case 28 integrally includes a support tube 28*a* projecting toward the lower case 27 and fitted to the extremity of the support shaft 27*b*, and a connecting wall portion 28*b* having an arc-shaped cross-section and surrounding a part of the support tube 28*a*.

The upper case 28 is secured to the connecting wall portion 27*c* of the lower case 27 by means of a screw member 32 in a state in which the support tube 28*a* is fitted to the extremity of the support shaft 27*b* and the connecting wall portions 27*c* and 28*b* are cause to abut against each other.

The support shaft 27*b* and the support tube 28*a*, which are fitted and joined to each other, run through a support hole 48 provided in a central area of the key head 16 of the mechanical key 12. The key head 16 held between the lower case 27 and the upper case 28 pivots around the axes of the support shaft 27*b* and the support tube 28*a* inwardly of the connecting wall portions 27*c* and 28*b* which are in a connected state.

The cover 30 is provided with a window 35 corresponding to an opening at the upper end of the support tube 28*a* of the upper case 28. The cover 30 is ultrasonically welded to the module case 29 in a state in which it is positioned relative to the module case 29.

An opening 39 for allowing the key plate 15 of the mechanical key 12 to project is formed between one end part of the module case 29 and the cover 30 so that one part of the outer periphery of the key head 16 faces the opening 39 when the mechanical key 12 is in the retracted position. A slit-shaped opening 40 is defined by the module case 29, the cover 30 and the module cover 31 such that the slit-shaped opening 40 opens on a side of the grip case 13 to communicate with the opening 39 in order that the mechanical key 12 is retracted into the grip case 13.

A bottomed cylindrical release button 41 is inserted vertically movably within the support shaft 27*b* and the support tube 28*a* so that a hemispherical closed portion at the upper end faces the window 35. A coil spring 42 is provided under compression between the lower case 27 and the release button 41, the coil spring 42 urging the release button 41 upward, that is, toward a side in which the release button 41 is moved away from the lower case 27.

Figure 14:
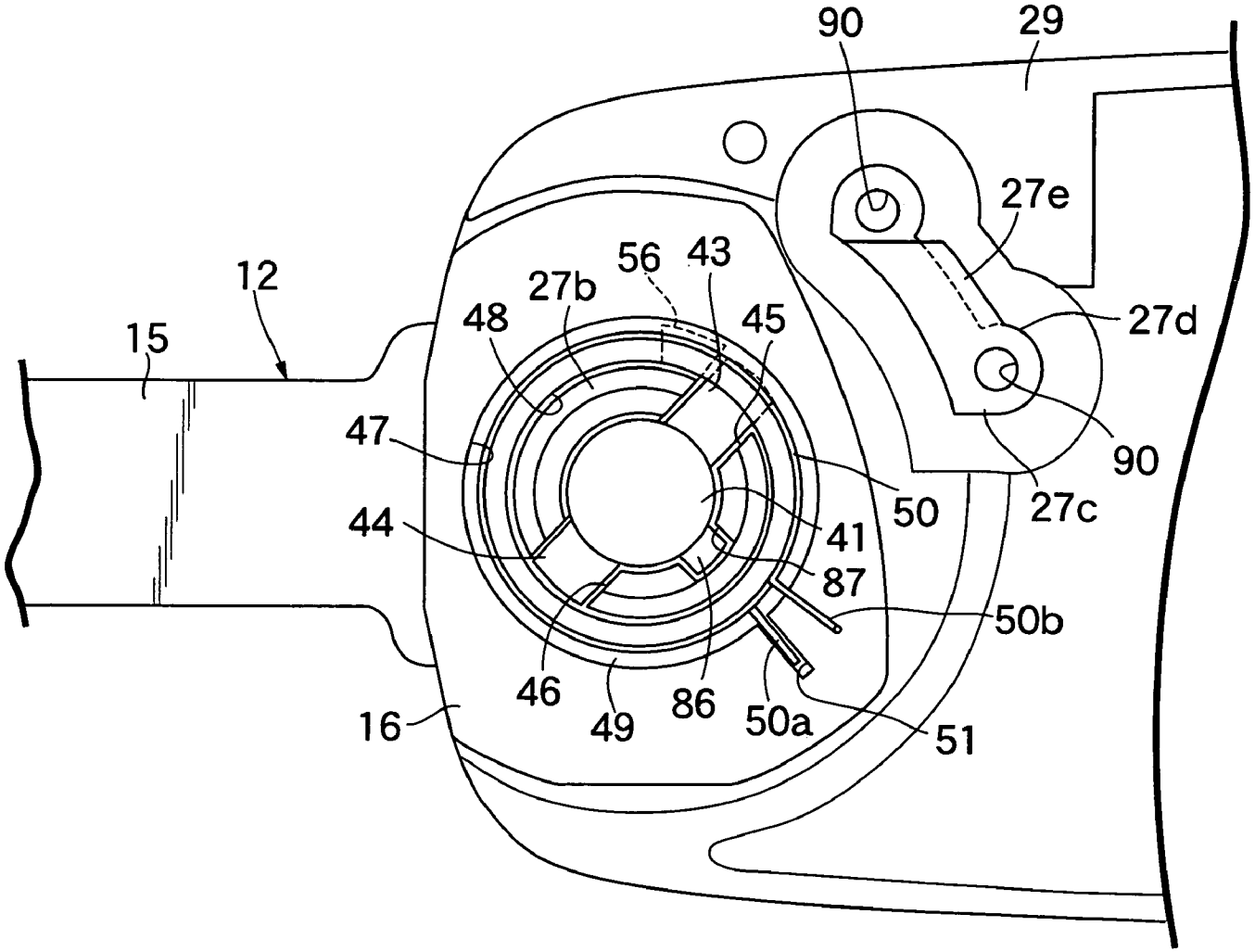
FIG. 14 is a side view showing a state in which the mechanical key is pivotably supported on a support shaft.

Referring also to FIG. 14, first and second restricting projections 43 and 44 are provided integrally with the outer periphery of the release button 41 on the lower case 27 side so as to project outward along one diameter of the release button 41. Further, first and second restricting holes 45 and 46 are provided in the support shaft 27*b* of the lower case 27, the restricting holes 45 and 46 extending axially in a slit shape. Fitting the two restricting projections 43 and 44 into the restricting holes 45 and 46 allows the release button 41 inserted within the support shaft 27*b* and the support tube 28*a* to move axially within a restricted range, and prevents the release button 41 from rotating within the support shaft 27*b* and the support tube 28*a*.

A positioning projection 86 is projectingly provided on the outer periphery of the release button 41 between the two restricting projections 43 and 44. A fitting groove 87 is provided on the inner periphery of the support shaft 27*b* so as to extend axially, the positioning projection 86 being slidably fitted into the fitting groove 87. Fitting the positioning projection 86 into the fitting groove 87*d* fixedly determines the relative positions of the support shaft 27*b* and the release button 41 around the axis of the support shaft 27*b*.

A support hole 48 allowing the support shaft 27*b* to be fitted thereinto is provided in a central part of the key head 16 of the mechanical key 12. A spring housing hole 47 is provided in the central part so as to communicate coaxially with one end of the support hole 48, the spring housing hole 47 having a diameter larger than that of the support hole 48 and having one end opening on a side face on the upper case 28 side so as to surround the extremity of the support shaft 27*b* and the support tube 28*a*. An annular step 49 is formed between the spring housing hole 47 and the support hole 48 so as to face the upper case 28 side.

A torsion spring 50 surrounding the support shaft 27*b* and the support tube 28*a* is disposed between the step 49 and the upper case 28 so as to be housed in the spring housing hole 47. The opposite ends of the torsion spring 50 are engaged with the upper case 28 and the key head 16. Thus, the torsion spring 50 exhibits a spring force for urging the key head 16, that is, the mechanical key 12, in a direction to pivot it from the retracted position to the projecting position.

As clearly shown in FIG. 14, an engagement portion 50*a* provided at one end of the torsion spring 50 is engaged with a latching hole 51 provided in a face of the key head 16 opposite the upper case 28 side so as to open in an inner face of the spring housing hole 47. As shown in FIG. 7 and FIG. 13, the upper case 28 is provided with a groove-shaped spring-latching portion 28*c* so as to be engaged with an engagement portion 50*b* provided at the other end of the torsion spring 50.

Figure 15:
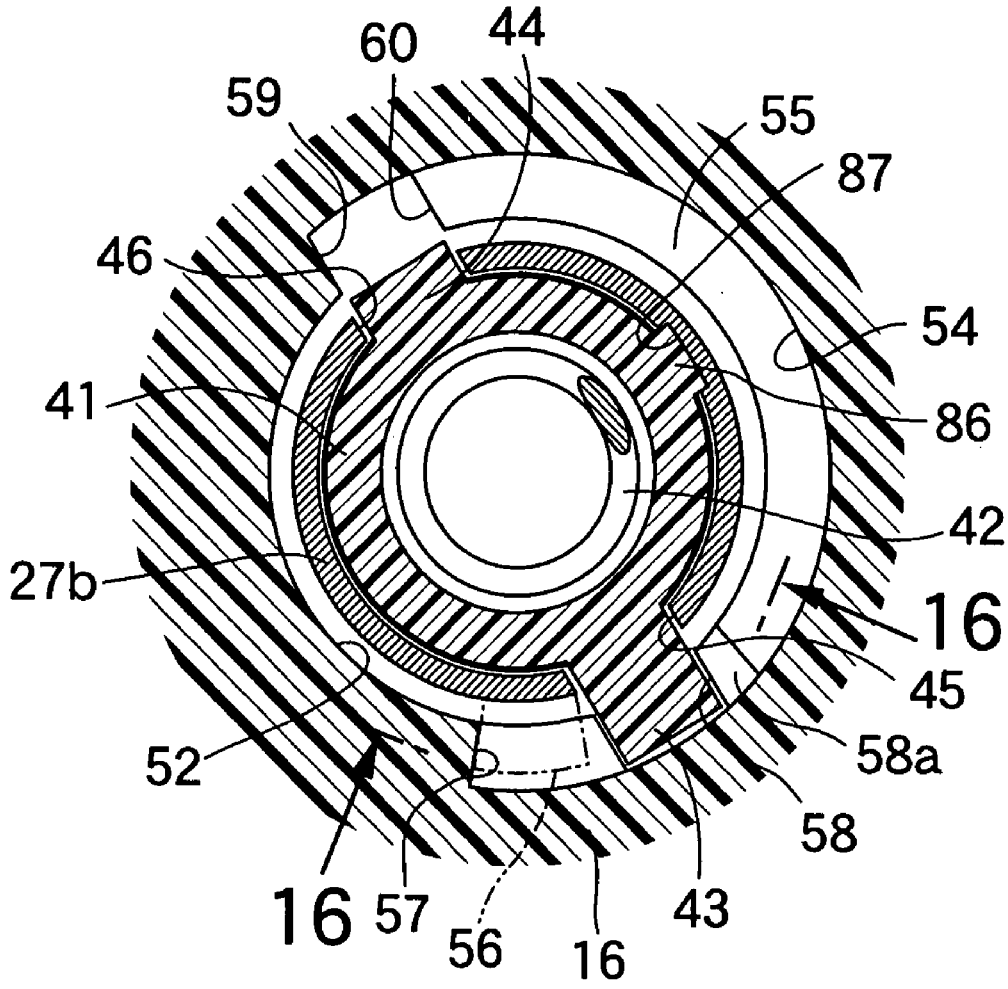
FIG. 15 is a sectional view along line 15-15 in FIG. 9.

Referring also to FIG. 15, the key head 16 is provided coaxially with an insertion hole 52 which has one end communicating coaxially with the other end of the support hole 48 and has a diameter larger than that of the support hole 48 so as to form an annular step 53 between the insertion hole 52 and the support hole 48 and to surround the support shaft 27*b*, the annular step 53 allowing the first and second restricting projections 43 and 44 to abut against it.

An arc-shaped guide recess 54 is provided in the key head 16 so as to enlarge a part of the inner periphery of the insertion hole 52 in a diameter-enlarging direction, the guide recess 54 allowing the first restricting projection 43 having its extremity projecting from the support shaft 27*b* to pivot relative to the key head 16 when the mechanical key 12 pivots between the retracted position and the projecting position. An arc-shaped sliding-contact step 55 is formed between the insertion hole 52 and the guide recess 54, the sliding-contact step 55 allowing the first restricting projection 43 to be in sliding contact with it.

Figure 16:
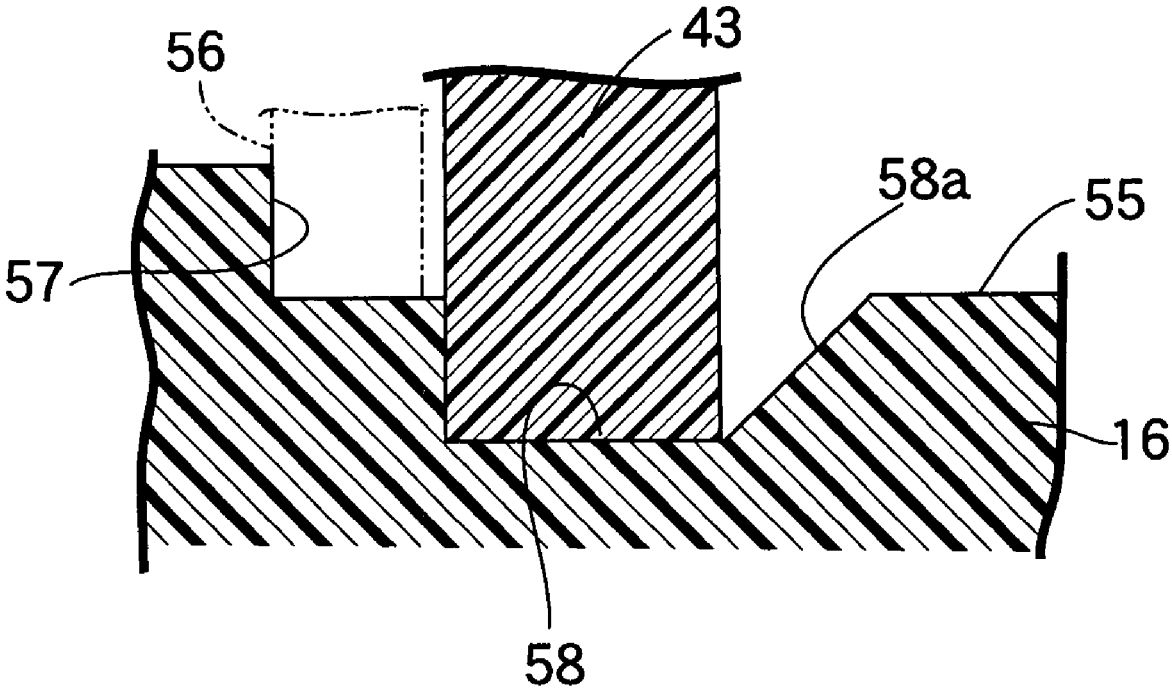
FIG. 16 is a sectional view along line 16-16 in FIG. 15.

Further, one end, in the peripheral direction, of the guide recess 54 is formed as a first restricting surface 57 against which a projection 56 abuts, the projection 56 being projectingly provided at a position adjacent to the first restricting hole 45 on the outer periphery of the support shaft 27*b*. The end, in the direction of pivoting toward the projecting position side, of the mechanical key 12 urged by the torsion spring 50 toward the projecting position is restricted by the first restricting surface 57 abutting against the projection 56 of the support shaft 27*b*. Furthermore, as shown in FIG. 16, a first fitting recess 58 is provided in the sliding-contact step 55 in the vicinity of the first restricting surface 57 so that the first restricting projection 43 is fitted into the first fitting recess 58. In a natural state in which no external force is applied to the release button 41 when the mechanical key 12 is at the projecting position while the first restricting surface 57 is abutting against the projection 56 of the support shaft 27*b*, the first restricting projection 43 of the release button 41 urged by the coil spring 42 is fitted into the first fitting recess 58, thereby retaining the mechanical key 12 at the projecting position. Moreover, an end wall, on the side opposite to the first restricting surface 57, of opposite end walls in the peripheral direction of the first fitting recess 58 is formed with a slant so that it functions as a cam surface 58*a*.

Furthermore, the other end in the peripheral direction of the guide recess 54 is formed as a second restricting surface 59, the first restricting projection 43 abutting against the second restricting surface 59 when the mechanical key 12 is at the retracted position. A second fitting recess 60 is provided at the other end in the peripheral direction of the sliding-contact step 55, the second fitting recess 60 receiving the first restricting projection 43 which abuts against the second restricting surface 59. That is, when in a natural state in which no external force is applied to the release button 41 when the second restricting surface 57 is abutting against the first restricting projection 43 and the mechanical key 12 is in the retracted position, the first restricting projection 43 of the release button 41 urged by the coil spring 42 is fitted into the second fitting recess 60, thereby retaining the mechanical key 12 at the retracted position.

When the mechanical key 12 is pivoted from the retracted position to the projecting position side, the release button 41 facing the window 35 is pushed against the spring force of the coil spring 42 and then released, whereby the key head 16 of the mechanical key 12 automatically pivots toward the projecting position by the spring force of the torsion spring 50 while the first restricting projection 43, which has separated from the second fitting recess 60, is in sliding contact with the sliding-contact step 55. At the projecting position, the release button 41 is pushed out by the coil spring 42 so that the first restricting projection 43 is fitted into the first fitting recess 58. Thus, the fitting between the first restricting projection 43 and the first fitting recess 58 retains the mechanical key 12 at the projecting position.

When the mechanical key 12 is pivoted from the projecting position to the retracted position, the release button 41 facing the window 35 is pushed against the spring force of the coil spring 42 during the initial stage of pivoting, whereby the first restricting projection 43, which has separated from the first fitting recess 58, can be manually pivoted to the retracted position while being in sliding contact with the sliding-contact step 55. At the retracted position, the release button 41 is pushed out by the coil spring 42 so that the first restricting projection 43 is fitted into the second fitting recess 60. Thus, the fitting between the first restricting projection 43 and the second fitting recess 60 retains the mechanical key 12 at the retracted position. A force may be applied to the key plate 15 of the mechanical key 12 so as to pivot it toward the retracted position without pushing in the release button 41, whereby the first restricting projection 43, which is fitted into the first fitting recess 58, moves the release button 41 toward the pushing-in side against the spring force of the coil spring 42 while ascending the cam surface 58*a*, thus separating the first restricting projection 43 from the first fitting recess 58 to allow the mechanical key 12 to pivot toward the retracted position.

Moreover, in a natural state in which no external force is applied to the release button 41, the first and second restricting projections 43 and 44 of the release button 41 resiliently urged by the coil spring 42 toward the projecting position abut against the key head 16 of the mechanical key 12, thus causing the key head 16 to be resiliently urged so as to be in sliding contact with the upper case 28.

Figure 17:
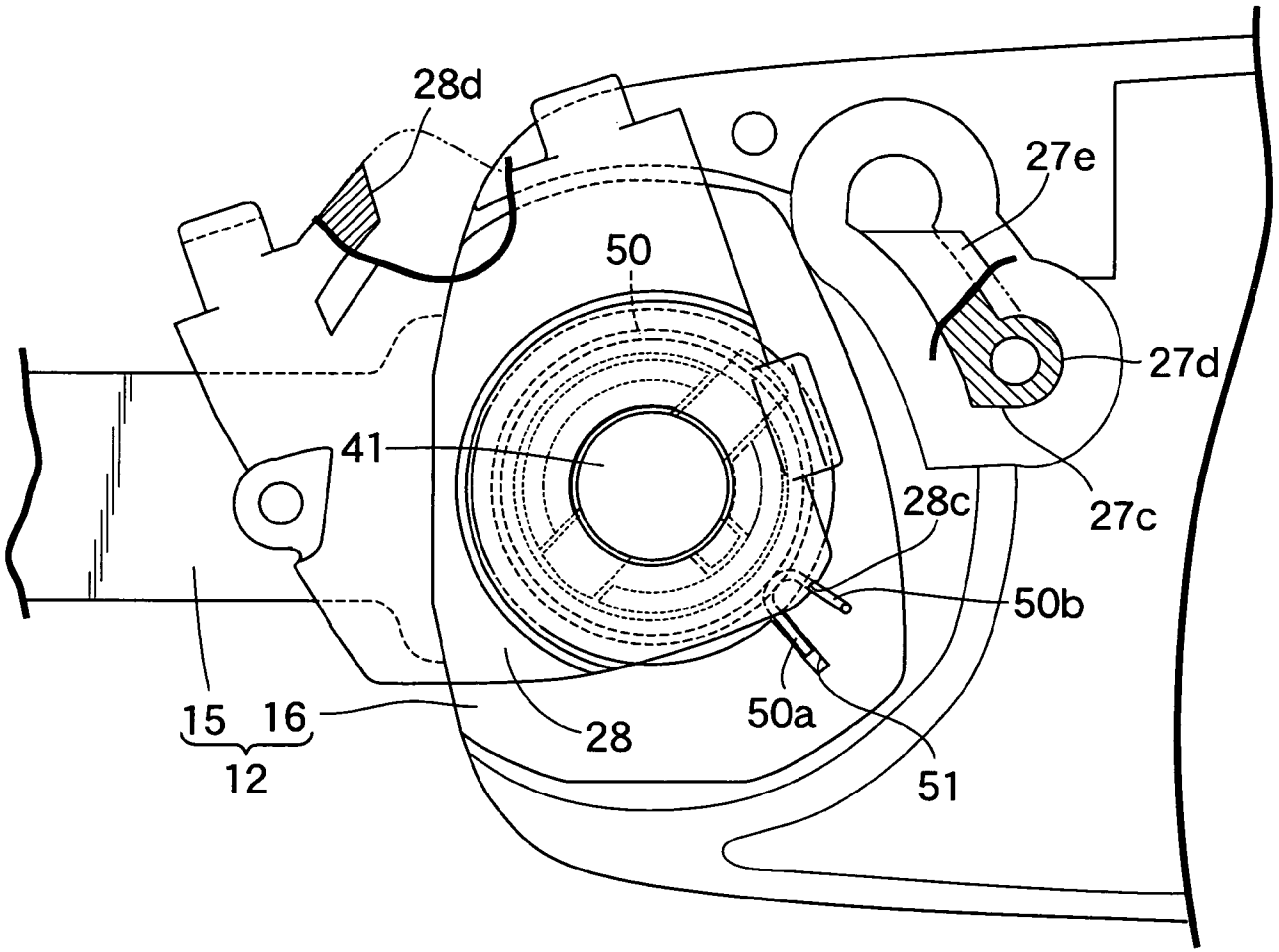
FIG. 17 is a side view showing a state in which the uppercase is at a spring-engagement position.

When assembling the upper case 28 to the lower case 27, the coil spring 42 and the release button 41 are first mounted on the support shaft 27*b* of the lower case 27; the mechanical key 12 having the support shaft 27*b* inserted into the support hole 48 of the key head 16 is arranged at the projecting position; the upper case 28 is disposed at a spring-engagement position shown in FIG. 17 while the support tube 28*a* of the upper case 28 is fitted and connected to the support shaft 27*b* in a state in which the engagement portion 50*a* at one end of the torsion spring 50 housed in the spring housing hole 47 of the key head 16 is engaged with the latching hole 51; and the engagement portion 50*b* at the other end of the torsion spring 50 in a natural state in which no external force is applied thereto is engaged with the spring-latching portion 28*c*.

Figure 18:
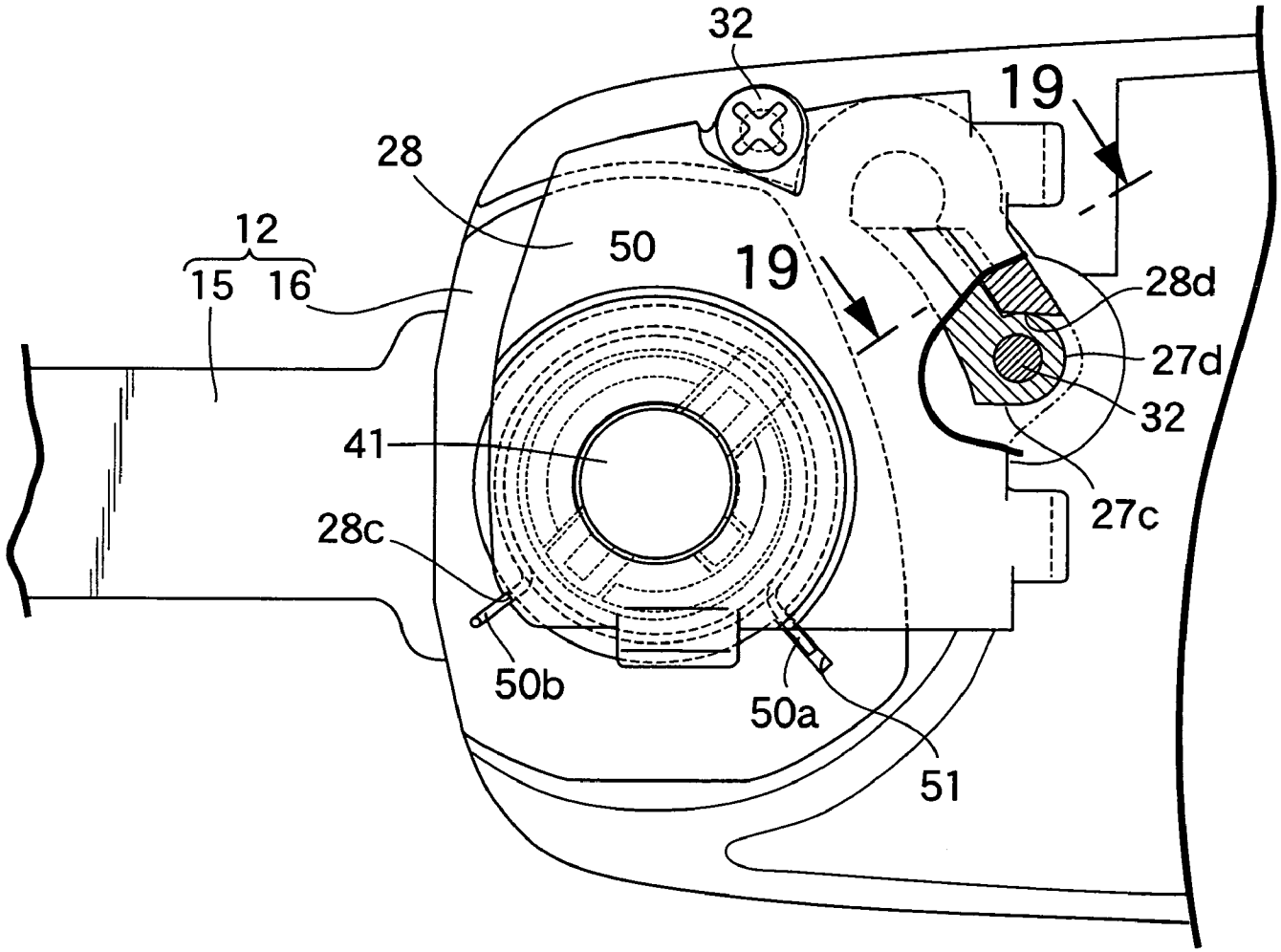
FIG. 18 is a partially cut-away side view, corresponding to FIG. 17, in a state in which the upper case pivoted to a securing position is secured to the lower case.

Subsequently, the upper case 28 abutting against the key head 16 in a state in which it is resiliently urged by the coil spring 42 is pivoted through a predetermined amount around the axis of the support shaft 27*b* to a securing position shown in FIG. 18 while pressing the upper case 28 against the spring force of the coil spring 42, and the connecting wall portion 28*b* of the upper case 28 is caused to abut against the connecting wall portion 27*c* of the lower case 27.

Pivoting of the upper case 28 from the spring-engagement position to the securing position winds the torsion spring 50 toward the side where a resilient force. is exhibited. A positioning restricting portion 27*d* is provided on the connecting wall portion 27*c* of the lower case 27 so as to bulge outward. The abutment surface 28*d* provided on the upper case 28 abuts against the positioning restricting portion 27*d* when the upper case 28 pivots to the securing position. Thus, the abutment surface 28*d* abuts against the positioning restricting portion 27*d*, thereby determining the securing position for the upper case 28.

Figure 19:
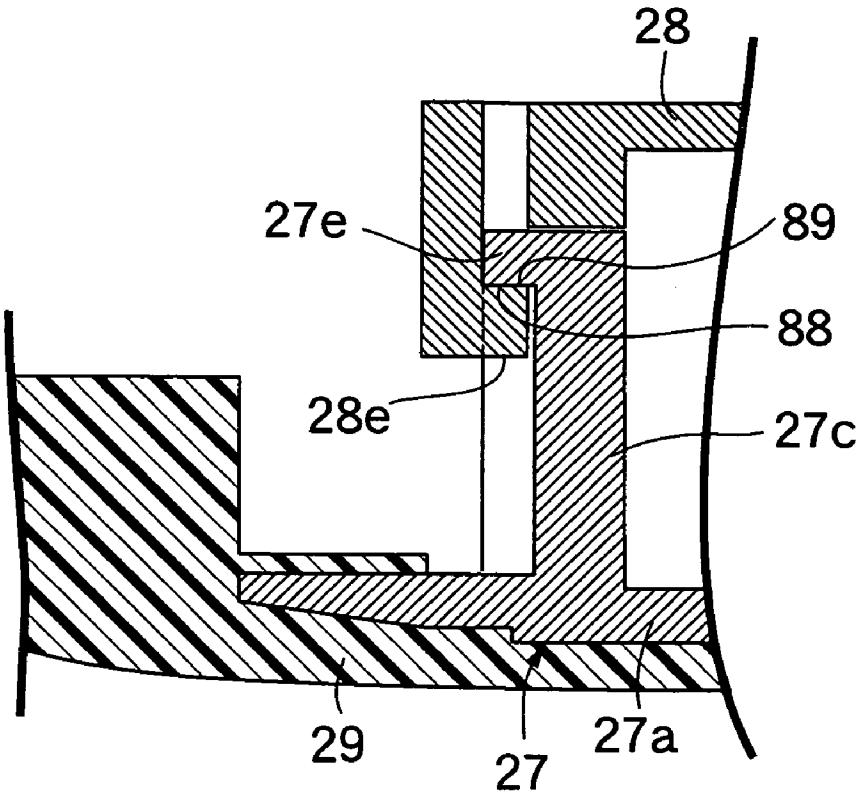
FIG. 19 is a sectional view along line 19-19 in FIG. 18.

As long as the release button 41 is not pushed in, the key head 16 resiliently abuts against the upper case 28, and a resilient force acts on the upper case 28 toward the side to separate it from the lower case 27. When the upper case 28 is at the securing position, as shown in FIG. 19, abutment surfaces 88 and 89 are formed on the connecting wall portion 27*c* of the lower case 27 and the connecting wall portion 28*b* of the upper case 28 respectively on a plane perpendicular to the axis of the support shaft 27*b*. The abutment surfaces 88 and 89 abutting against each other so as to receive the resilient force acting on the upper case 28 in a direction in which they are in pressure contact with each other. Specifically, a projection 27*e* projecting outward is provided integrally on the connecting wall portion 27*c* of the lower case 27, and a projection 28*e* is provided integrally on the connecting wall portion 28*b* of the upper case 28 so as to face the projection 27*e* from the base plate 27*a* side of the lower case 27 when the upper case 28 is at the securing position, whereby opposed surfaces of the projection 27*e* and the projection 28*e* are formed to be the abutment surfaces 88 and 89, respectively.

The connecting wall portion 27*c* of the lower case 27 is provided with a plurality, for example, a pair, of threaded holes 90. The connecting wall portion 28*b* of the upper case 28 is provided with through-holes 91 that communicate with the threaded holes 90 when the upper case 28 is at the securing position. Screwing and tightening screw members 32, which have been passed through the through-holes 91, into the threaded holes 90 when the upper case 28 is at the securing position secures the upper case 28 to the lower case 27.

Referring to FIG. 7 in particular, a keyless module 62 is housed between the module case 29 and the module cover 31, and a recess 61 is formed in the keyless module 62 so as to face the module case 29 side, the recess 61 forming between itself and the module case 29 a space for housing the key plate 15 of the mechanical key 12 at the retracted position.

The keyless module 62 includes a locking button 65, an unlocking button 66, and a panic button 67. The keyless module 62 is designed so that pushing the locking button 65 outputs a signal for automatically locking a door lock mechanism provided in an automobile, pushing the unlocking button 66 outputs a signal for automatically unlocking the door lock mechanism, and pushing the panic button 67 outputs a signal for urging an alarm operation on the automobile side. The buttons 65, 66 and 67 are disposed so as to face windows 68, 69 and 70 provided in the module cover 31, respectively.

The module cover 31 engages with the cover 30 and resiliently engages with the module case 29. A mounting leg part 74 projecting toward the module case 29 is provided integrally on the module cover 31 at the end on the side opposite to the side on which the mechanical key 12 projects. The module case 29 is provided with a metal nut 75 facing the tip of the mounting leg part 74. A screw member 33 passed through the module case 29 and the tip of the mounting leg part 74 is screwed into the nut 75.

Figure 20:
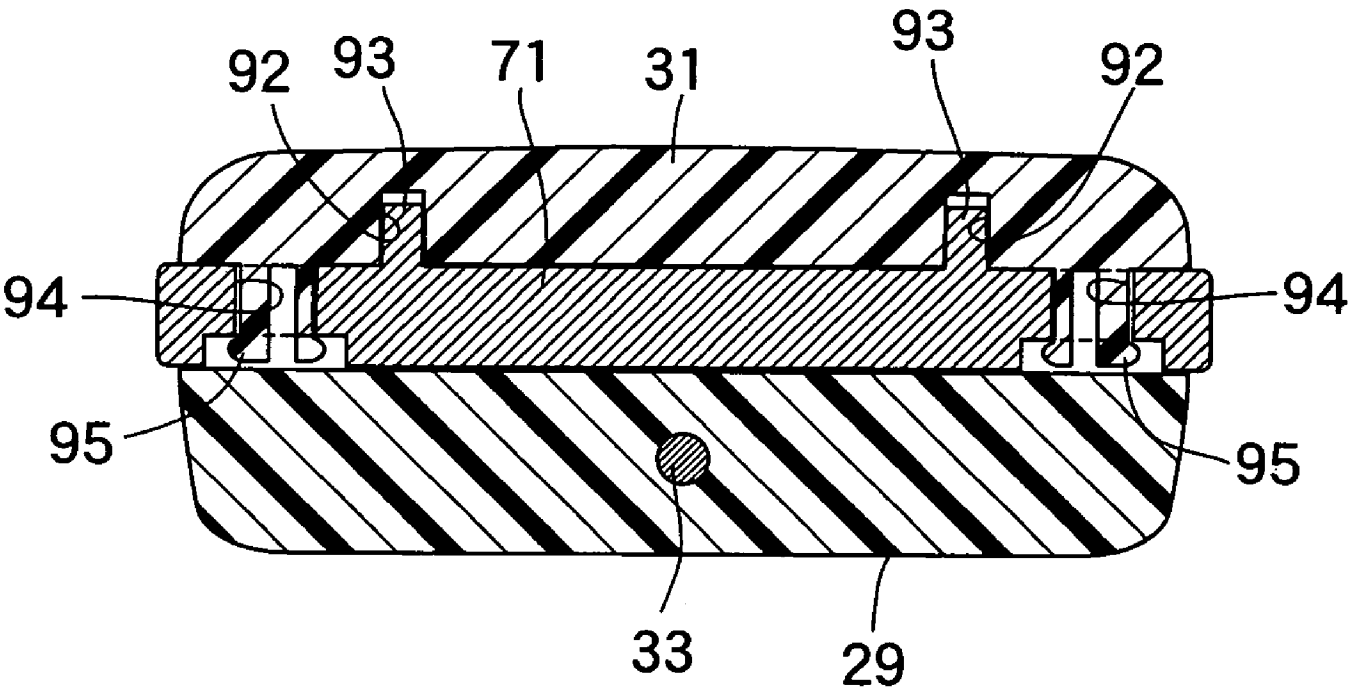
FIG. 20 is a sectional view along line 20-20 in FIG. 1.

Referring also to FIG. 20, a metal holder ring 71 for connecting to a key holder (not illustrated) is clamped between the module case 29 and the module cover 31 on a side opposite to the side on which the mechanical key 12 projects such that a most part of the metal holder ring 71 projects from the grip case 13.

Further, at least one of the module case 29 and the module cover 31, in this embodiment the module cover 31, is provided with a plurality, for example, a pair, of bottomed fitting holes 92 and 92, and the holder ring 71 is provided integrally with fitting projections 93 and 93 that are fitted into the two fitting holes 92 respectively.

Furthermore, the holder ring 71 is provided with a plurality, for example, a pair, of engagement holes 94 and 94, and engagement hooks 95 and 95 are projectingly provided integrally on the module cover 31 so as to resiliently engage with the two engagement holes 94 respectively.

The operation of this embodiment is now described. The mechanical key 12 comprises: the key plate 15 being capable of being inserted into the cylinder lock 24; and the key head 16 joined to one end of the key plate 15. The key head 16 of the mechanical key 12 is supported in the grip case 13 so that it can pivot between the retracted position in which the entire mechanical key 12 is retracted, and the projecting position in which the key plate 15 is caused to project. The transponder 14 for transmitting a specified ID code signal to the cylinder lock 24 side is built in the key head 16.

Therefore, even if the mechanical key 12 is detached from the grip case 13 due to damage, etc., a signal can be exchanged with the cylinder lock 24 only by the mechanical key 12, that is, the engine can be started only by the mechanical key 12, because the transponder 14 is housed within the key head 16 of the mechanical key 12.

Furthermore, the spring-engagement position and the securing position are set around the support shaft 27*b* of the lower case 27. In the spring-engagement position, the torsion spring 50 in a natural state in which a spring force is not exhibited has one end engaged with the key head 16 of the mechanical key 12, and has the other end engaged with the spring-latching portion 28*c* of the upper case 28 which is not secured to the lower case 27. In the securing position, the upper case 28 having the torsion spring 50 engaging with the spring-latching portion 28*c* is pivoted by a predetermined amount toward the side that causes the torsion spring 50 to exhibit a resilient force. The positioning restricting portion 27*d* is provided on the connecting wall portion 27*c* of the lower case 27 so as to abut against the upper case 28 pivoted from the spring-engagement position to the securing position around the axis of the support shaft 27*b*.

Therefore, the support shaft 27*b* of the lower case 27 is fitted into the support hole 48 of the key head 16; said other end of the torsion spring 50 in a natural state with said one end engaged with the key head 16, is engaged with the spring-latching portion 28*c* of the upper case 28 disposed at the spring-engagement position in a state in which the support tube 28*a* is fitted and connected to the extremity of the support shaft 27*b*; the upper case 28 is pivoted around the support shaft 27*b* so as to twist it from the spring-engagement position to the side that causes the torsion spring 50 to exhibit a resilient force and cause it to abut against the positioning restricting portion 27*d*, whereby the lower case 27 reaches the securing position and the torsion spring 50 is twisted so as to exhibit a predetermined resilient force. In this state, the, upper case 28 is secured to the lower case 27, thereby securing the upper case 28 to the lower case 27 by a simple assembly operation without requiring a special tool or a skilled worker to reduce the number of operation steps.

Further, the abutment surfaces 88 and 89 are formed on the lower case 27 and the upper case 28 respectively on the plane perpendicular to the axis of the support shaft 27*b* such that the abutment surfaces 88 and 89 abut against each other so as to receive the spring force of the coil spring 42 in a direction in which they are in pressure contact with each other in a state in which the upper case 28 spring-biased to the side in which it separates from the lower case 27 is at the securing position. Therefore, when the upper case 28 is pivoted until it abuts against the positioning restricting portion 27*d*, the abutment surfaces 88 and 89 of the lower case 27 and the upper case 28 come into pressure contact with each other due to the spring force acting on the upper case 28. Thus, even if a hand is detached from the upper case 28, the frictional force due to the pressure contact between the abutment surfaces 88 and 89 prevents the upper case 28 from returning from the securing position to the spring-engagement position side, thus facilitating assembly operation.

Furthermore, the fitting projections 93, which are fitted respectively into the pair of fitting holes 92 provided in the module cover 31, are provided integrally on the metal holder ring 71 held between the module case 29 and the module cover 31, and the engagement hooks 95, which resiliently engage with, for example, the pair of engagement holes 94 provided in the holder ring 72, are projectingly provided integrally with the module cover 31. Therefore, when the module case 29 and the module cover 31 are joined to each other in a state in which the engagement hooks 95 of the module cover 31 resiliently engage with the engagement holes 94 of the holder ring 71 and the fitting projections 93 of the holder ring 71 are fitted into the fitting holes 92 of the module cover 31, the holder ring 71 is mounted on the grip case 13 while being clamped between the module case 29 and the module cover 31.

Moreover, the holder ring 71 can be provisionally assembled to the module cover 31 by resilient engagement between the engagement hooks 95 and the engagement holes 94, thus facilitating assembling; and the pair of fitting projections 93 of the holder ring 71 are fitted into the fitting holes 92 of the module cover 31, whereby even if an external force acts on the holder ring 71, the external force is dispersed to a plurality of positions and acts on the positions where the holder ring 71 is attached to the grip case 13, thus enhancing the assembly strength.

Furthermore, the lower case 27 includes the base plate 27*a* insert-bonded to the inner face side of the module case 29, and the support shaft 27*b* connected to the base plate 27*a* at right angles. The slide mold 84 is disposed in the mold 82 so that it can move in the radial direction of the support shaft 27*b* so as to determine the position of the lower case 27 along the axial direction of the support shaft 27*b* by engaging with the support shaft 27*b*, the mold 82 being used for molding the inner face side of the module case 29 while determining the position of the lower case 27 in a direction perpendicular to the axis of the support shaft 27*b* when the lower case 27 is insert-bonded to the module case 29.

Therefore, when the base plate 27*a* of the lower case 27 is insert-bonded to the inner face side of the module case 29, the position of the lower case 27 in a direction along the axis of the support shaft 27*b*, namely, the thicknesswise direction of the module case 29, is fixedly determined by the slide mold 84. That is, the lower case 27 is not moved even by resin pressure when molding the module case 29. Thus, the position of the lower case 27 in the thicknesswise direction of the module case 29 can reliably be fixedly determined, and the outer face of the module case 29 can be formed to be a stable and reliable design surface.

An embodiment of the present invention has been described above, but the present invention is not limited to the above-described embodiment and can be modified in a variety of ways as long as the modifications do not depart from the present invention described in the claims.

What is claimed is:

1. A key unit comprising:

a grip case which includes at least a pair of synthetic resin case members joined to each other; and a mechanical key which is supported in the grip case and which includes a key plate capable of being inserted into a cylinder lock and a key head joined to one end of the key plate;

the key head being capable of pivoting the mechanical key between a retracted position in which the entire mechanical key is retracted and a projecting position in which the key plate projects, wherein the key unit further comprises a metal holder ring which is held between the two case members and which integrally includes a plurality of fitting projections, the fitting projections respectively being fitted into a plurality of fitting holes provided in at least one of the case members; and wherein an engagement hook is projectingly provided integrally on one of the case members so as to resiliently engage with an engagement hole provided in the holder ring.

2. The key unit according to claim 1, wherein the key plate has a circular support hole; wherein the grip case comprises, as some of the components, a support member having a support shaft fitted into the support hole, and a clamping member secured to the support member with the key head held between the clamping member and the support member; wherein a torsion spring has one end engaging with the key head so as to exhibit a resilient force for urging the mechanical key to a side that causes the key plate to project, and has the other end engaging with a spring-latching portion provided on the clamping member; wherein the clamping member is provided integrally with a support tube fitted and connected to an extremity of the support shaft; wherein the support shaft includes, around a periphery, a spring-engagement position and a securing position, in the spring-engagement position the torsion spring in a natural state with one end engaged with the key head without exhibiting no spring force causes the other end to be engaged with the spring-latching portion of the clamping member which is not secured to the support member, and in the securing position the clamping member having the torsion spring engaged with the spring-latching portion is pivoted by a predetermined amount to a side that causes the torsion spring to exhibit a resilient force; wherein a positioning restricting portion is provided on the support member so as to abut against the clamping member that has been pivoted from the spring-engagement position to the securing position around an axis of the support shaft; and wherein the clamping member abutting against the positioning restricting portion is secured to the support member.

3. The key unit according to claim 2, wherein abutment surfaces are respectively formed on the support member and the clamping member on a plane perpendicular to the axis of the support shaft, the abutment surfaces abutting against each other such that the spring force urging the clamping member away from the support member is received in a direction in which the abutment surfaces are in pressure contact with each other when the clamping member is at the securing position.

* * * * *